US010519957B2

(12) United States Patent
Völker

(10) Patent No.: US 10,519,957 B2
(45) Date of Patent: Dec. 31, 2019

(54) PUMP

(71) Applicant: CONTINENTAL AUTOMOTIVE GmbH, Hannover (DE)

(72) Inventor: Marc Völker, Magdeburg (DE)

(73) Assignee: Continental Automotive GmbH, Hannover (DE)

( * ) Notice: Subject to any disclaimer, the term of this patent is extended or adjusted under 35 U.S.C. 154(b) by 239 days.

(21) Appl. No.: 15/029,069

(22) PCT Filed: Oct. 13, 2014

(86) PCT No.: PCT/EP2014/071844
§ 371 (c)(1),
(2) Date: Apr. 13, 2016

(87) PCT Pub. No.: WO2015/055556
PCT Pub. Date: Apr. 23, 2015

(65) Prior Publication Data

US 2016/0230766 A1 Aug. 11, 2016

(30) Foreign Application Priority Data

Oct. 14, 2013 (DE) ..... 10 2013 220 717

(51) Int. Cl.
*F04D 5/00* (2006.01)
*F04D 13/06* (2006.01)
*F02M 25/00* (2006.01)
*F04D 3/00* (2006.01)

(52) U.S. Cl.
CPC ..... *F04D 13/06* (2013.01); *F02M 25/00* (2013.01); *F04D 3/00* (2013.01); *F04D 5/006* (2013.01)

(58) Field of Classification Search
CPC ..... F04D 13/06; F04D 3/00; F04D 5/006; F02M 25/00
See application file for complete search history.

(56) References Cited

U.S. PATENT DOCUMENTS 3,263,909 A * 8/1966 Mazepa ..... A47L 5/22 415/199.3
3,336,876 A * 8/1967 Streuli ..... F04D 5/00 415/100
4,296,347 A 10/1981 Weirauch
(Continued)

FOREIGN PATENT DOCUMENTS

CN 2795507 7/2006
CN 200949554 9/2007
(Continued)

OTHER PUBLICATIONS

Office Action which issued in the corresponding Chinese Patent Application No. 201480056337.2.

*Primary Examiner* — Charles G Freay
*Assistant Examiner* — Thomas Fink
(74) *Attorney, Agent, or Firm* — Cozen O'Connor

(57) ABSTRACT

A pump with a housing, in which an electric motor of a pump step which can be driven by a shaft of the electric motor is arranged. A second pump step which can be driven by the shaft is arranged in series with the first pump step, both pump steps being designed as peripheral or lateral channel steps and the running wheels of both pump steps are arranged counter to the direction of conveyance of other pump step.

3 Claims, 1 Drawing Sheet

(56) References Cited

U.S. PATENT DOCUMENTS 4,396,347 A 8/1983 Chang
5,009,575 A * 4/1991 Hanai ..... F04D 5/006 415/55.1
5,129,796 A * 7/1992 Emmert ..... F02M 37/048 415/55.6
5,642,981 A * 7/1997 Kato ..... F04D 29/188 415/55.1
6,113,363 A * 9/2000 Talaski ..... F02M 37/048 415/55.1
7,090,460 B2 * 8/2006 Englander ..... F04D 17/168 415/54.1
9,249,806 B2 * 2/2016 Talaski ..... F04D 5/005
2001/0041132 A1 * 11/2001 Marx ..... F04D 5/005 415/55.1
2003/0231952 A1 * 12/2003 Moss ..... F04D 29/188 415/55.1
2003/0231953 A1 * 12/2003 Ross ..... F04D 5/005 415/55.1
2004/0223842 A1 * 11/2004 Talaski ..... F04D 5/006 415/55.5
2005/0074345 A1 * 4/2005 Deichmann ..... F04D 5/005 417/423.14
2005/0163627 A1 * 7/2005 Morris ..... F04D 5/006 417/244
2007/0104567 A1 * 5/2007 Narisako ..... F04D 29/188 415/55.1
2010/0163215 A1 * 7/2010 Li ..... F04D 1/06 165/120
2012/0301289 A1 11/2012 Fischer et al.
2012/0328412 A1 * 12/2012 Quail ..... F04D 13/10 415/68

FOREIGN PATENT DOCUMENTS

CN 102812252 12/2012
CN 202789686 3/2013
DE 431682 C * 7/1926 ..... F04D 19/005
DE 11 77 939 9/1964
DE 102 27 426 7/2003
EP 0467336 A2 * 1/1992 ..... F04D 19/005
JP 3690075 B2 * 8/2005 ..... F04D 19/005

* cited by examiner

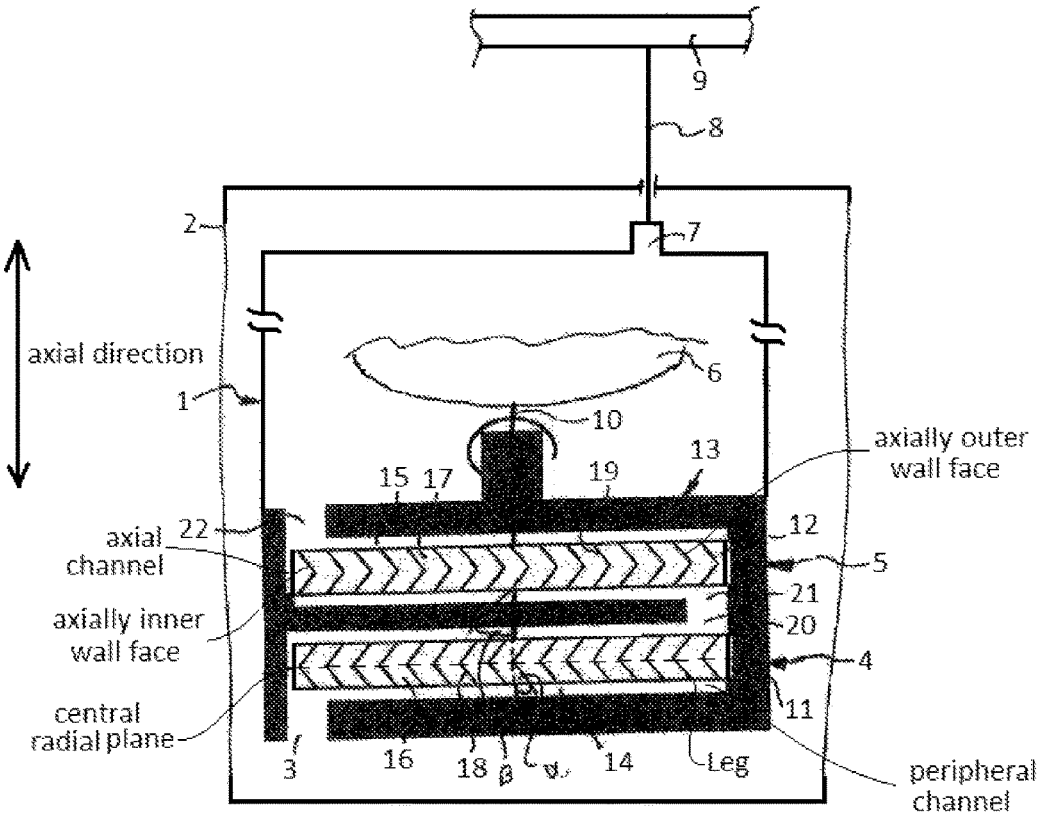
9
8
2
7
axial direction
6
1
10
axially outer wall face
13
15
17
19
22
12
axial channel
5
21
axially inner wall face
20
4
central radial plane
11
3
16
18
β
14
Leg
peripheral channel

PUMP

CROSS REFERENCE TO RELATED APPLICATIONS

This is a U.S. national stage of application No. PCT/EP2014/071844 filed on Oct. 13, 2014. Priority is claimed on German Application No. DE 10 2013 220 717.4 filed Oct. 14, 2013, the content of which IS incorporated here by reference.

BACKGROUND OF THE INVENTION

1. Field of the Invention

The invention relates to a pump having a housing in which an electric motor of a pump stage driven by a shaft of the electric motor is arranged.

2. Description of the Prior Art

Such pumps are known and are used in motor vehicles for conveying additives added to the fuel. The added additives are intended to reduce nitrogen oxides in the exhaust gas of motor vehicles. As a result of the chemical reaction, which is brought about thereby, these pumps are also known as SCR pumps. The additive is supplied by the SCR pump from a container via a line to the fuel. To prevent freezing of the line that contains the additive, the line is emptied outside travel operation. The emptying is carried out by reversing the polarity of the rotation direction of the SCR pump so that the conveying direction of the SCR pump is directed from the line into the additive container. Positive-displacement pumps are used since these can convey in both a forward and backward direction depending on the rotation direction. The disadvantage of positive-displacement pumps is their more complex construction is consequently more cost-intensive.

SUMMARY OF THE INVENTION

An aspect of the invention is to provide a cost-effective pump that can convey in two directions with little complexity by reversing the rotation direction.

One aspect of the invention is that a second pump stage, which can be driven by the shaft, is arranged in series with respect to the first pump stage. Both pump stages are constructed as peripheral and/or lateral channel stages and the impellers of the two pump stages are arranged counter to the conveying direction of the other pump stage in each case.

With the use of peripheral and/or lateral channel stages, pump stages of the flow pump type are used in place of positive-displacement pumps. These are significantly more cost-effective than positive-displacement pumps as a result of the structure thereof. In this instance, it is consciously accepted that the peripheral or lateral channel stages can convey in only one direction so that for each conveying direction a pump stage is required. With this arrangement, depending on the rotation direction of the electric motor, an impeller carries out the conveying operation, whilst the other impeller as a result of its opposing arrangement counteracts the conveying. Since the influence of the impeller acting in the conveying direction is always greater than the impeller counteracting the conveying direction, a conveying action is thus enabled in two directions each with a pump stage of the flow pump type. As a result of the relatively low conveying quantity both in the main conveying direction when adding the additive and in the subsidiary conveying direction when emptying the line, the reduction of the conveying capacity is surpassed by the advantages of the use of peripheral or lateral channel stages with respect to a positive-displacement pump. An additional feature is the significantly better adjustability of peripheral and lateral channel pumps with respect to positive-displacement pumps, in particular with a low conveying quantity.

An increase of the conveying capacity is achieved when the two impellers have a V-shaped blade arrangement.

In one advantageous embodiment, the angles of the V-shaped blade arrangement of both impellers are different. In this manner, the impellers can be adapted to their respective conveying operation.

A particularly good degree of efficiency is achieved when the angle of the V-shaped blade arrangement of the impeller conveys in the main conveying direction is greater than the angle of the V-shaped blade arrangement of the other impeller. As a result of the simple construction and the good adjustability under the given conveying conditions, the pump according to one aspect of the invention is suitable in particular as an SCR pump for conveying an additive added to the fuel of a motor vehicle.

BRIEF DESCRIPTION OF THE DRAWINGS

The invention is described in greater detail with reference to an embodiment. The single FIGURE shows a pump according to the invention as an SCR pump in a motor vehicle.

DETAILED DESCRIPTION OF THE PRESENTLY PREFERRED EMBODIMENTS

The pump 1 is arranged in an additive container 2 from which it draws the additive in the main conveying direction via an inlet 3 and conveys it via the first pump stage 4 and the second pump stage 5 by the electric motor 6 to an outlet 7. The outlet 7 is connected to a conveying line 8 via which the additive is added to the fuel 9. However, it is also conceivable for the pump 1 to be arranged outside the additive container 2. The intake of the additive is then carried out via a suction line connected to the inlet 3 and is guided in the additive container 2. The pump 1 has a housing in which the electric motor 6 is arranged with the shaft 10 thereof. The shaft 10 is constructed for carrying, in a rotationally secure manner, two impellers 11, 12 arranged in a pump housing 13. The first impeller 11 forms with the associated pump chamber 14 the first pump stage 4, whilst the second impeller 12 forms the second pump stage 5 with the pump chamber 15. Both impellers 11, 12 are constructed as lateral channel wheels. The impellers 11, 12 have at each of the two sides a ring of blades 18, 19 that delimit blade chambers 16, 17. The blades 18, 19 are constructed on the respective impeller as a V-shaped blade arrangement, wherein the orientation of the V-shaped blade arrangement of an impeller 11 is counter to the V-shaped blade arrangement of the other impeller 12.

When the shaft 10 of the electric motor 3 rotates in the main conveying direction, the impeller 11 rotates in such a manner that the additive is drawn in via the inlet 3 and is conveyed to an outlet 20 of the first pump stage 4. From there, the additive flows via an inlet 21 of the second pump stage 5 into the pump chamber 15 with the second impeller 12. The V-shaped blade arrangement thereof is directed counter to the flow direction of the additive. The additive leaves the pump housing via an outlet 22 after flowing through the second pump chamber 15.

For the subsidiary flow direction, the polarity of the electric motor 3 is reversed so that the shaft 10 rotates in the opposite direction. As a result of the orientation of the V-shaped blade arrangements of the two impellers 11, 12, the impeller 12 of the second pump stage 5 now draws additive via the outlet 22 and conveys it through the pump chamber 15 to the inlet 21 and via the outlet 20 counter to the resistance of the impeller 11 of the first pump stage 4 via the inlet 3 into the additive container 2. In this manner, the conveying line 8 is emptied, whereby a freezing of the conveying line 8 with the resultant loss of the additive admixture is prevented.

In the illustration shown, the angles α, β at which the blades 18, 19 are inclined with respect to the shaft 10 are identical. However, it is also conceivable for the angle β of the blades 9 of the impeller 12 which conveys in the subsidiary conveying direction to be selected to be smaller than the angle α.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A pump comprising:

a housing;

an electric motor having a shaft arranged in the housing;

a first pump stage configured as one of a peripheral channel stage and a lateral channel stage arranged in the housing and configured to be driven by the shaft;

a first stage impeller of the first pump stage configured to convey liquid in a first direction;

a second pump stage configured as one of a peripheral channel stages and a lateral channel stage arranged in the housing and in series with the first pump stage and configured to be driven by the shaft; and a second stage impeller of the second pump stage configured to convey the liquid in a second direction opposite the first direction, wherein the first stage impeller and the second stage impeller each have a V-shaped blade arrangement, each V-shaped blade arrangement comprising two legs, each leg of the V-shape having an axially inner wall face and an axially outer wall face extending axially toward a central radial plane of each respective impeller, wherein based on a direction of rotation of the electric motor one of the first stage impeller and the second stage impeller is a main conveying impeller conveying the liquid in a corresponding one of the first direction or the second direction, and wherein the liquid to be conveyed first comes into contact with the main conveying impeller before it reaches the other impeller, wherein respective angles of the V-shaped blade arrangement of the first stage impeller and the second stage impeller are different.

2. The pump as claimed in claim 1, wherein an angle of the V-shaped blade arrangement of the first stage impeller is greater than an angle of the V-shaped blade arrangement of the second stage impeller.

3. The use of a pump as claimed in claim 1, wherein the pump is an SCR pump configured to add an additive to a fuel in a motor vehicle.

* * * * *